US010082355B2

(12) United States Patent
Addis

(10) Patent No.: US 10,082,355 B2
(45) Date of Patent: Sep. 25, 2018

(54) MUZZLE ADAPTER FOR A FIREARM

(71) Applicant: Jonathan D. Addis, Grand Rapids, OH (US)

(72) Inventor: Jonathan D. Addis, Grand Rapids, OH (US)

( * ) Notice: Subject to any disclaimer, the term of this patent is extended or adjusted under 35 U.S.C. 154(b) by 0 days.

(21) Appl. No.: 15/642,671

(22) Filed: Jul. 6, 2017

(65) Prior Publication Data

US 2018/0017352 A1 Jan. 18, 2018

Related U.S. Application Data

(60) Provisional application No. 62/362,618, filed on Jul. 15, 2016.

(51) Int. Cl.
*F41A 21/36* (2006.01)
*F41A 21/32* (2006.01)

(52) U.S. Cl.
CPC ..... *F41A 21/36* (2013.01); *F41A 21/325* (2013.01)

(58) Field of Classification Search
CPC ..... F41A 21/325; F41A 21/36
See application file for complete search history.

(56) References Cited

U.S. PATENT DOCUMENTS 4,510,843 A * 4/1985 Rabatin ..... F41A 21/325 89/14.4
4,939,977 A * 7/1990 Stroup ..... F41A 21/30 89/14.4
6,385,891 B1 * 5/2002 Rabatin ..... F41A 21/30 42/77
7,353,740 B1 * 4/2008 Hoffman ..... F41A 21/26 42/107
8,210,087 B2 * 7/2012 Latka ..... F41A 21/30 89/14.3
8,973,481 B2 * 3/2015 Dueck ..... F41A 21/325 181/223
9,182,187 B1 * 11/2015 Griffith ..... F41A 21/32
9,500,427 B1 * 11/2016 Larue ..... F41A 21/30
9,513,078 B1 * 12/2016 Fulton ..... F41A 21/30
9,739,560 B1 * 8/2017 Salvador ..... F41A 21/325
9,921,021 B1 * 3/2018 Graham, II ..... F41A 21/325
(Continued)

*Primary Examiner* — Stephen Johnson
*Assistant Examiner* — Joshua T Semick
(74) *Attorney, Agent, or Firm* — Bennet K. Langlotz; Langlotz Patent & Trademark Works, Inc.

(57) ABSTRACT

A muzzle adapter for a firearm has an adapter element defining an adapter bore centered on an adapter bore axis, a portion of the adapter bore being internally threaded to removably mate with the threaded muzzle, the adapter element having a tapered exterior surface portion, the adapter element having an externally threaded portion, a muzzle device defining a device bore and having a tapered internal bore portion adapted to be closely received on the tapered exterior surface portion of the adapter element, a collar element internally threaded to mate with the externally threaded portion of the adapter element, and the collar element being axially engaged to the muzzle device and rotatably independent of the muzzle device, such that rotation of the collar draws the muzzle device onto the adapter element and wedges the tapered portion of the adapter element into the tapered internal bore portion of the muzzle device.

22 Claims, 3 Drawing Sheets

(56) References Cited

U.S. PATENT DOCUMENTS

| | | | | |
|---|---|---|---|---|
| 2014/0237881 | A1* | 8/2014 | Mack | F41A 21/325<br>42/90 |
| 2016/0097609 | A1* | 4/2016 | Penchuk | F41A 21/325<br>42/76.01 |
| 2017/0205176 | A1* | 7/2017 | Whitson | F41A 21/325 |

* cited by examiner

MUZZLE ADAPTER FOR A FIREARM

REFERENCE TO RELATED APPLICATION

This application claims priority to U.S. Provisional Application Ser. No. 62/362,618 filed Jul. 15, 2016, and entitled, "SYSTEM FOR ATTACHING MUZZLE DEVICES TO A GUN BARREL."

FIELD OF THE INVENTION

The present invention relates to firearms, and more particularly to a facility for mounting a device on the muzzle, such as a muzzle brake or sound suppressor, without requiring professional alignment of the device.

BACKGROUND OF THE INVENTION

It is often desirable to mount removable devices at the muzzle of a firearm, such as a muzzle brake or a sound suppressor. A muzzle brake is a device connected to the muzzle of a firearm that redirects propellant gases to counter recoil with a rearward expulsion of combustion gases and unwanted rising of the barrel after firing. A suppressor is a device attached to the barrel of a firearm that reduces the amount of noise and usually the amount of muzzle flash generated by firing the weapon. A suppressor is usually a metal cylinder with internal mechanisms such as baffles to reduce the sound of firing by slowing the escaping propellant gas and sometimes by reducing the velocity of the bullet.

Although suppressors can usually be attached to the host firearm without concern for rotational alignment, muzzle brakes are radially asymmetrical. Many will typically generate gas flow through lateral apertures, avoiding gas blasting downward into the dirt to reveal a shooter's position with the resulting cloud of dust, and avoiding blasting upward to potentially affect optics or generate unbalanced vertical forces. Compensators are a form of muzzle brake used to generate a radial force, typically downward to counteract muzzle rise during recoil of rifle or pistol shooting.

Therefore, muzzle brakes traditionally require timing/rotational alignment so the device is in its correct position for proper operation. This requires special designs, elements or systems that increase weight, complexity, bulk, or cost, or require costly custom gunsmithing and other special installation skills. The measures taken to provide timing alignment requirement not only increase the cost of attaching a muzzle brake to a firearm, but also increase the difficulty of switching between a muzzle brake and a suppressor, which will generally have a different mounting mechanism than a specially timed device, and may suffer disadvantages of weight, bulk and extra length if a special device is used.

Therefore, a need exists for a new and improved muzzle adapter for a firearm that enables an end user to correctly time a muzzle device mounted on the muzzle adapter. In this regard, the various embodiments of the present invention substantially fulfill at least some of these needs. In this respect, the muzzle adapter for a firearm according to the present invention substantially departs from the conventional concepts and designs of the prior art, and in doing so provides an apparatus primarily developed for the purpose of enabling an end user to correctly time a muzzle device mounted on the muzzle adapter.

SUMMARY OF THE INVENTION

The present invention provides an improved muzzle adapter for a firearm, and overcomes the above-mentioned disadvantages and drawbacks of the prior art. As such, the general purpose of the present invention, which will be described subsequently in greater detail, is to provide an improved muzzle adapter for a firearm that has all the advantages of the prior art mentioned above.

To attain this, the preferred embodiment of the present invention essentially comprises an adapter element defining an adapter bore centered on an adapter bore axis, a portion of the central bore being internally threaded to removably mate with the threaded muzzle with the adapter bore registered with the barrel bore, the adapter element having a tapered exterior surface portion, the adapter element having an externally threaded portion, a muzzle device defining a device bore and having a tapered internal bore portion adapted to be closely received on the tapered exterior surface portion of the adapter element, a collar element internally threaded to mate with the externally threaded portion of the adapter element, and the collar element being axially engaged to the muzzle device and rotatably independent of the muzzle device, such that with the muzzle device oriented in a selected orientation respect to the adapter element, rotation of the collar draws the muzzle device onto the adapter element and wedges the tapered portion of the adapter element into the tapered internal bore portion of the muzzle device to prevent unwanted rotation of the muzzle device with respect to the adapter element. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
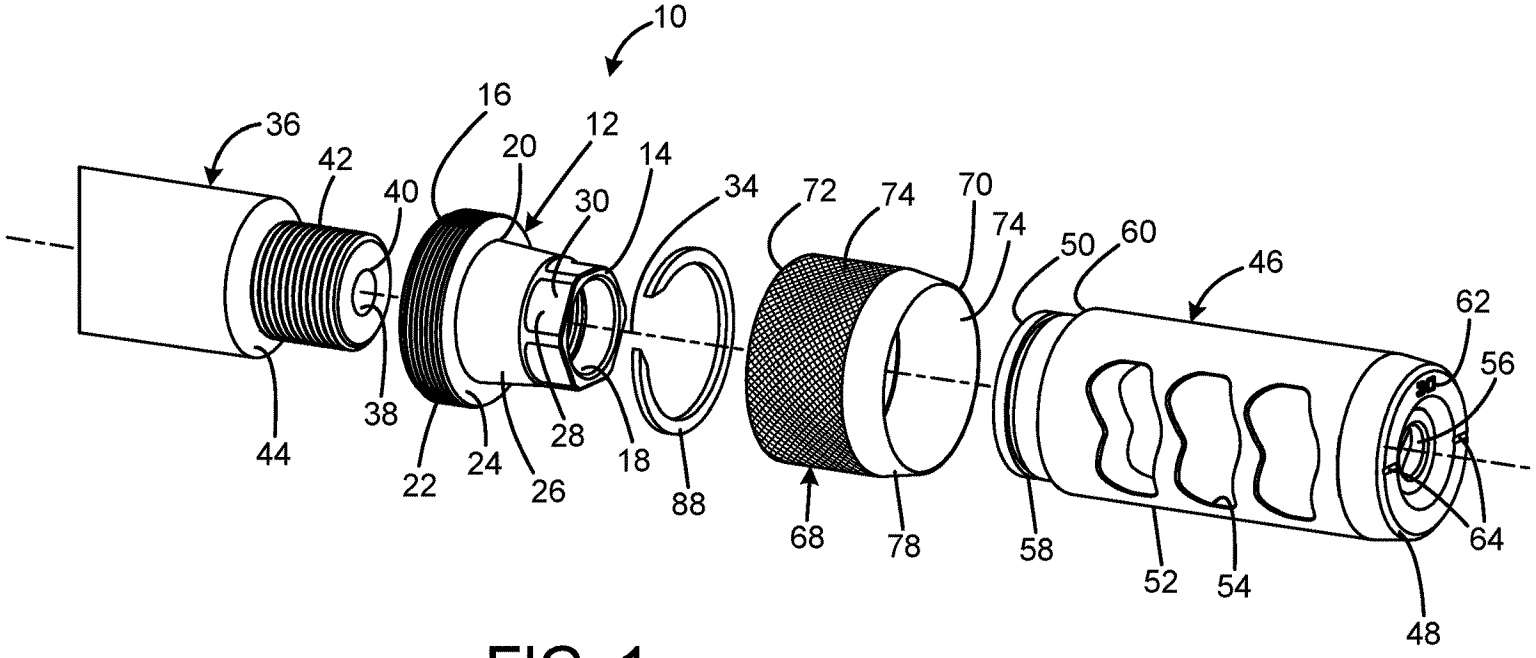
FIG. 1 is a front isometric view of the current embodiment of a muzzle adapter for a firearm constructed in accordance with the principles of the present invention with a muzzle brake.

An embodiment of the muzzle adapter for a firearm of the present invention is shown and generally designated by the reference numeral 10.

Figure 2:
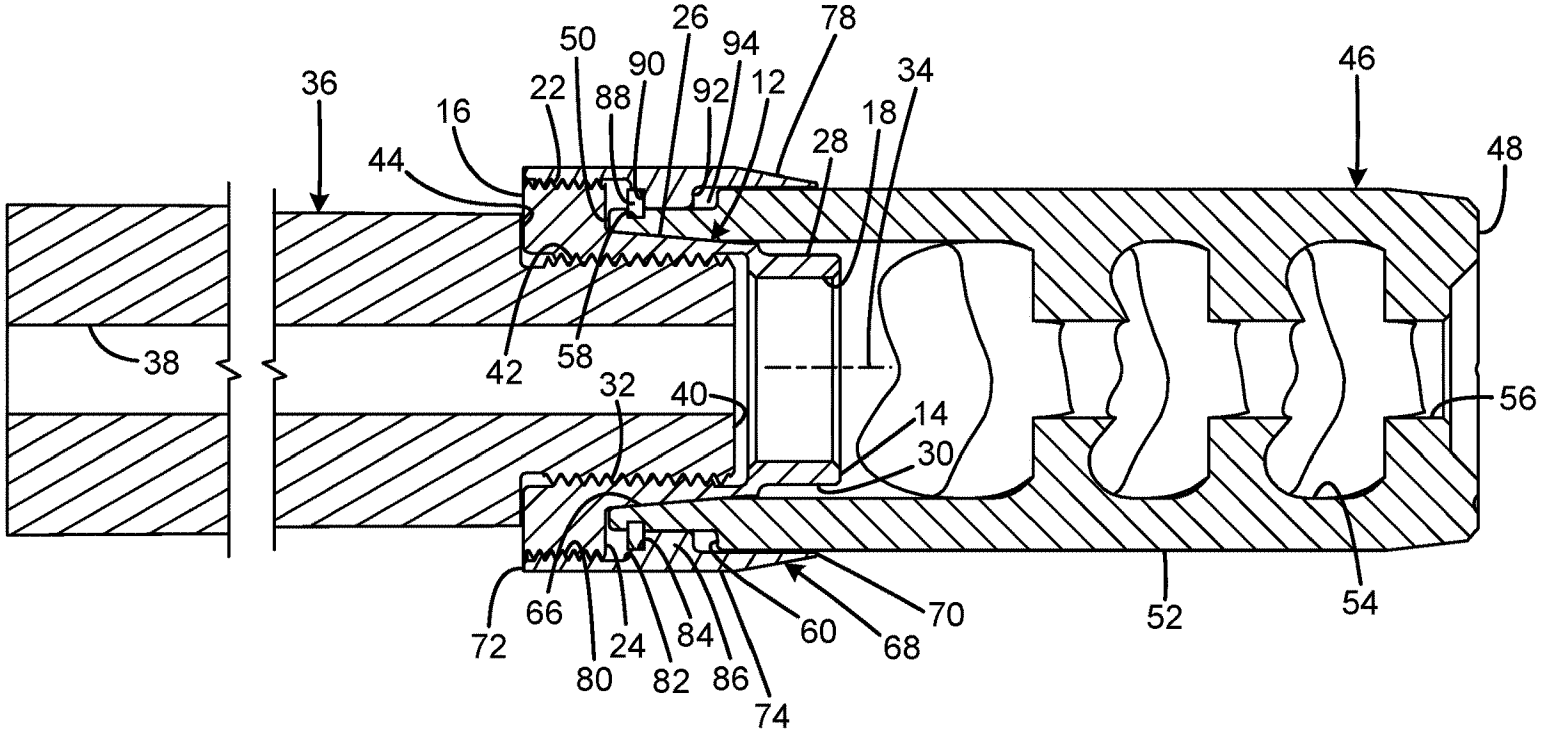
FIG. 2 is a side sectional view of the muzzle adapter for a firearm of the present invention with a muzzle brake.

FIGS. 1 and 2 illustrate the improved muzzle adapter for a firearm 10 of the present invention. More particularly, the muzzle adapter is shown with a muzzle brake 46 with a locking collar element 68. The muzzle adapter has an adapter element 12 having a front 14, rear 16, adapter bore 18, and an exterior 20. The rear exterior of the adapter element defines external threads 22. A forward-facing shoulder 24 is located immediately in front of the external threads. A tapered exterior surface portion 26 extends forward of the forward-facing shoulder to a tool engagement facility 28. The tool engagement facility includes at least one flat surface 30. The rear of the adapter bore defines internal threads 32. The adapter bore defines an adapter bore axis 34. In the current embodiment, the external threads are 32 tpi left handed threads, the tapered exterior surface portion is a cone at an angle of 5°, and the tool engagement facility is a hexagonal shape adapted to enable a torque tool to secure the adapter element to a barrel 36.

The barrel 36 defines a barrel bore 38 and includes a muzzle 40 with muzzle threads 42. A forward-facing shoulder 44 is located immediately behind the muzzle threads. In the current embodiment, the muzzle threads have a pitch of ⅝-24 3 A. To install the adapter element 12 on the muzzle, the internal threads 32 of the adapter element are first hand tightened into threaded engagement with the threads 42 on the muzzle. Subsequently, a torque tool (not shown) is engaged with the tool engagement facility 28 of the adapter element to torque the adapter element to 25 ft./lb. with the rear 16 of the adapter element abutting the shoulder of the barrel.

Once the adapter element 12 is secured to the muzzle 40 of the barrel 36, any desired muzzle device can be attached to the adapter element. In FIGS. 1 and 2, the muzzle device is a muzzle brake 46 having a front 48, a rear 50, an exterior 52 defining three ports 54, and a device bore 56. The rear exterior of the muzzle brake has a stepped down section that defines a snap ring groove 58 and a rear shoulder 60. The front of the muzzle brake includes a caliber indicium 62 and two leveling indicia 64. The rear of the device bore includes a tapered internal bore portion 66. In the current embodiment, the tapered internal bore portion is a cone at an angle of 5°. The tapered internal bore portion interfaces with the tapered exterior surface portion 26 on the adapter element 12 to guarantee alignment of the muzzle brake with the internal threads 32 of the adapter element. The internal threads of the adapter element in turn are aligned with the muzzle threads 42 and barrel bore 38 of the barrel 36.

The collar element 68 is attached to the rear 50 of the exterior 52 of the muzzle brake 46. The collar element has a front 70, rear 72, knurled exterior surface 74, and a central bore 76. The front of the collar element defines an exterior tapered portion 78 that fits over the exterior of the muzzle brake to provide an attractive aesthetic appearance. The rear of the central bore defines internal threads 80, which are 32 tpi left hand threads in the current embodiment to threadedly engage with the adapter element external threads 22. In front of the internal threads within the central bore are a series of steps 82, 84 and a lug 86. The largest diameter step 82 enables installation and removal of a snap ring 88 from within the central bore. The smaller diameter step 84 is positioned over the snap ring when the collar element is attached to the rear of the muzzle brake. The step 84 ensures the snap ring remains trapped in the snap ring groove 58 during normal operation. The lug has an internal rearward facing shoulder 90 that pushes against the snap ring in order to pull the muzzle brake onto the adapter element 12 when the collar element is threadedly engaged with the adapter element external threads. The lug has an internal forward-facing shoulder 92 that leaves a gap 94 relative to the rear shoulder 60 of the muzzle brake when the collar element is threadedly engaged with the adapter element external threads. The lug is separated from the stepped down section of the rear exterior of the muzzle brake by 0.003 inch in the current embodiment. The portion of the central bore of the collar element in front of the lug is separated from the exterior of the muzzle brake by at least 0.005 inch in the current embodiment.

To install the muzzle brake 46 on the adapter element 12, the collar element 68 is first attached to the rear 50 of the muzzle brake with the snap ring 88 received in the snap ring groove 58. Subsequently, the rear of the muzzle brake is slid onto the tapered exterior surface portion 26 of the adapter element. The collar element is then rotated counterclockwise to threadedly engage the left-handed internal threads 80 with the left-handed adapter element external threads 22 until the collar element is finger tight. The muzzle brake is then rotated until the leveling indicia 64 are level with the ports 54 horizontal and the narrower side of the ports pointing downward. Then, the muzzle brake is pushed rearward firmly until the tapered internal bore portion 66 of the muzzle brake is locked onto the tapered exterior surface portion 26 of the adapter element with the rear 50 of the muzzle brake 0.01 inch in front of the forward-facing shoulder 24 of the collar element. The collar element is then firmly hand tightened to complete the installation. The knurled exterior surface 74 of the collar element provides the end user with a secure location for gripping the collar element. The collar element is expected to tighten over time because of the use of left-handed threads in the collar element and the adapter element external threads with a right-hand twist barrel 36.

To clean the muzzle adapter 10, the collar element 68 is first unscrewed from the adapter element external threads 22. Then, the muzzle brake 46 is slid forward off the tapered exterior surface portion 26 of the adapter element 12. The end user then wipes any carbon buildup off the tapered exterior surface portion and the tapered internal bore portion 66 of the muzzle brake using a rag and solvent. Any especially stubborn carbon buildup can be removed with 00 steel wool. Once the tapered surfaces are clean to ensure accuracy and reliability, the muzzle brake and collar element are ready to be installed on the adapter element as described previously. The adapter element does not have to be detached from the barrel 36 for cleaning.

Figure 3:
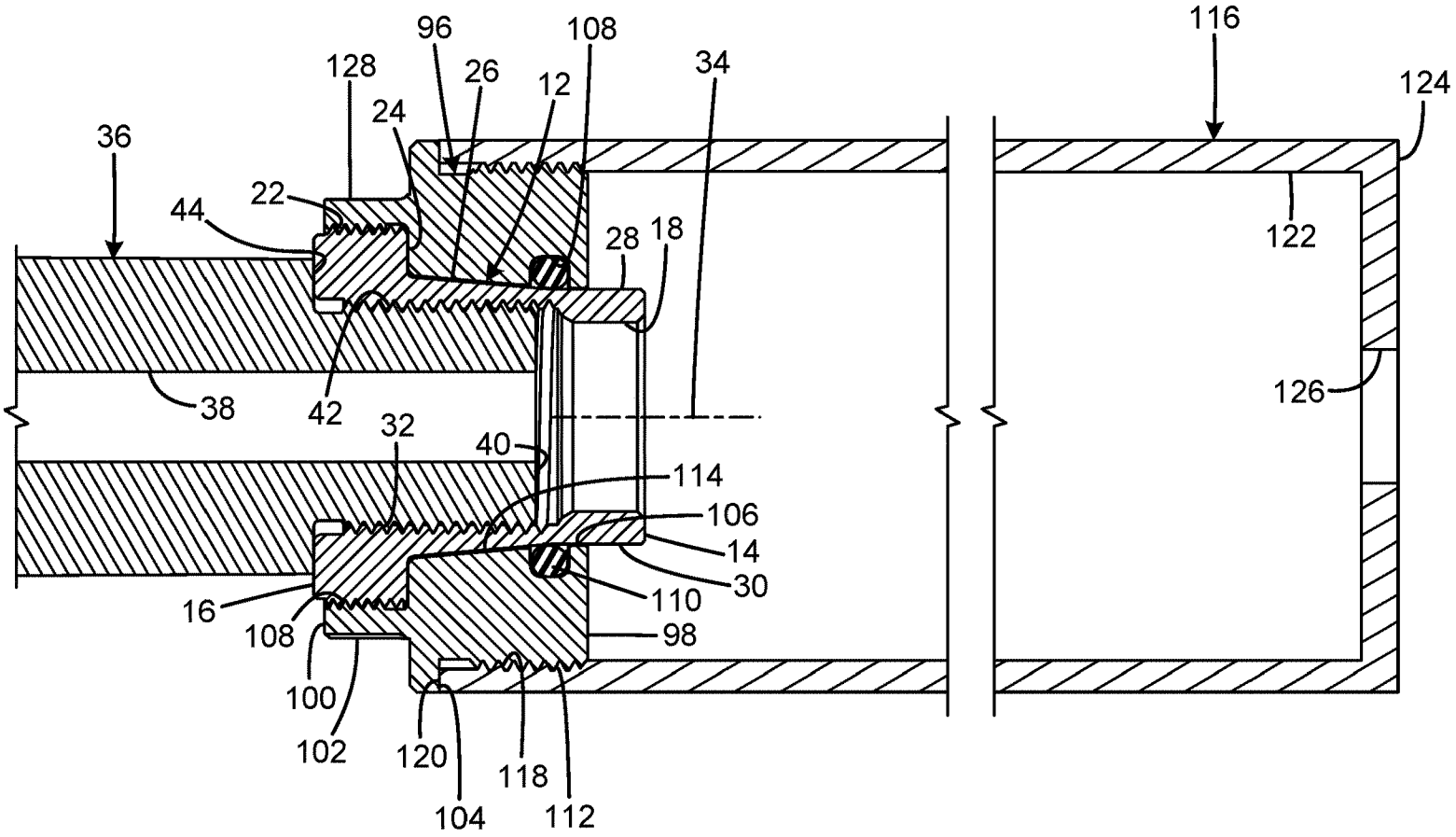
FIG. 3 is a side sectional view of the muzzle adapter for a firearm of the present invention with a suppressor adapter and suppressor.

FIG. 3 illustrates the improved muzzle adapter for a firearm 10 of the present invention. More particularly, the muzzle adapter is shown with a suppressor mount 96 and a suppressor 116. The adapter element 12 is secured to the muzzle 40 of the barrel 36 in the manner described previously. In FIG. 3, the muzzle device attached to the adapter element is a suppressor with a suppressor mount adapted to attach to the adapter element. The suppressor mount 96 has a front 98, rear 100, exterior 102, exterior shoulder 104, central bore 106, and external threads 112. The rear of the central bore has internal threads 108 that are threadedly engaged with the adapter element external threads 22. The front of the central bore defines an O-ring groove 108 that receives an O-ring 110. A tapered interior surface portion 114 extends from the internal threads 108 to the front of the suppressor mount. In the current embodiment, the tapered interior surface portion is a cone at an angle of 5°. The rear exterior of the suppressor mount defines a tool engagement facility 128 to facilitate tightly engaging the internal threads of the suppressor mount with the adapter element external threads.

The suppressor 116 is threadedly engaged with the external threads 112 of the suppressor mount 96 by internal threads 118 within the rear 120 of a central bore 122. The rear of the suppressor abuts the shoulder 104 of the suppressor mount. The front 124 of the suppressor defines an aperture 126 that is narrower than the central bore in the current embodiment and is axially registered with the adapter bore axis 34. The internal mechanisms of the suppressor, such as baffles, have been omitted for clarity. In the current embodiment, the O-ring creates a gas seal between the tapered exterior surface portion 26 of the adapter element 12 and the tapered interior surface portion of the suppressor mount. This gas seal prevents back pressure fouling when a round is discharged through the barrel 36. In the current embodiment, the O-ring is a super resilient, high-temperature silicone O-ring.

To clean the muzzle adapter 10, the suppressor mount 96 is unscrewed from the adapter element external threads 22. Then, the suppressor mount is slid forward off the tapered exterior surface portion 26 of the adapter element 12. The end user then wipes any carbon buildup off the tapered exterior surface portion and the tapered interior surface portion 114 of the suppressor mount using a rag and solvent. Any especially stubborn carbon buildup can be removed with 00 steel wool. The suppressor mount can also be unscrewed from the suppressor 116 to enable cleaning of the internal mechanisms of the suppressor. Once the tapered surfaces are clean to ensure accuracy and reliability, and the suppressor is attached to the suppressor mount, the suppressor and suppressor mount are ready to be installed on the adapter element as described previously.

In the current embodiment, the muzzle threads 42 are narrower than the barrel 36. The adapter element external threads 22 are wider than the barrel. The rear 72 of the collar element 68 is wider than the adapter element external threads. The rear 50 of the muzzle brake 46 is narrower than the adapter element external threads and wider than the barrel. The rear 100 of the suppressor mount 96 is wider than the adapter element external threads. The external threads 112 of the suppressor mount are wider than the rear of the suppressor mount. The shoulder 104 of the suppressor mount is wider than the external threads of the suppressor mount. The front 14 of the adapter bore 18 is narrower than the rear 16 of the adapter bore. The rear of the device bore 56 is wider than the front of the device bore. The front of the device bore terminates in a chamfer. The rear of the central bore 106 is wider than the front 98 of the central bore.

In the context of the specification, the terms "rear" and "rearward" and "front" and "forward" have the following definitions: "rear" or "rearward" means in the direction away from the muzzle of the firearm, while "front" or "forward" means in the direction towards the muzzle of the firearm.

While a current embodiment of a muzzle adapter for a firearm has been described in detail, it should be apparent that modifications and variations thereto are possible, all of which fall within the true spirit and scope of the invention. For example, although a muzzle brake and a sound suppressor have been described, the muzzle adapter can also be used with other muzzle-mounted devices, such as recoil compensators, /hiders, and blank firing adapters. Furthermore, although a hexagonal-shaped tool engagement facility has been described, any suitable shape to support any suitable tightening method can be used, including 12 point, star, spanner type, anti-reverse bearing, and spin a wrench. In addition, although a cone at an angle of 5° has been described for the tapered exterior surface portion of the adapter element, the tapered internal bore portion of the muzzle brake, and the tapered interior surface portion of the suppressor mount, any angle less than 45° generates a mechanical advantage to secure a muzzle device to the adapter element. Angles less than 30° provide a beneficial 2:1 advantage, and angles less than 10° provide substantially improved performance. Finally, it should be appreciated that front and exterior of the suppressor mount can be modified to fit any desired suppressor.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A muzzle assembly for a firearm with a barrel defining a barrel bore and having a threaded muzzle, the muzzle device comprising:

an adapter element defining an adapter bore centered on an adapter bore axis;

a portion of the adapter bore being internally threaded to removably mate with the threaded muzzle with the adapter bore registered with the barrel bore;

the adapter element having a tapered exterior surface portion;

the adapter element having an externally-threaded portion;

a muzzle device defining a device bore and having a tapered internal bore portion adapted to be closely received on the tapered exterior surface portion of the adapter element;

a collar element internally threaded to mate with the externally-threaded portion of the adapter element; and the collar element being axially engaged to the muzzle device and rotatably independent of the muzzle device, such that with the muzzle device oriented in a selected orientation with respect to the adapter element, rotation of the collar draws the muzzle device onto the adapter element and wedges the tapered exterior surface portion of the adapter element into the tapered internal bore portion of the muzzle device to prevent unwanted rotation of the muzzle device with respect to the adapter element.

2. The muzzle assembly of claim 1 wherein the tapered exterior surface portion of the adapter element is frustoconical.

3. The muzzle assembly of claim 1 wherein the tapered exterior surface portion of the adapter element is forward of the externally-threaded portion of the adapter element.

4. The muzzle assembly of claim 1 wherein the adapter element includes a tool-engagement facility adapted to enable a torque tool to secure the adapter element to the barrel.

5. The muzzle assembly of claim 1 wherein the tool-engagement facility includes a flat surface forward of the exterior surface portion of the adapter element.

6. The muzzle assembly of claim 1 wherein the adapter element includes a forward-facing shoulder forward of the externally-threaded portion.

7. The muzzle assembly of claim 1 wherein the tapered exterior surface portion is angularly offset from the adapter bore axis by less than 45°.

8. The muzzle assembly of claim 1 wherein the muzzle device has an external forward-facing shoulder and the collar has an abutting internal rearward facing shoulder, such that the collar is adapted to forcibly draw the muzzle device in a rearward direction.

9. The muzzle assembly of claim 1 wherein the tapered exterior surface portion of the adapter element and the tapered portion of the muzzle device have the same shape.

10. The muzzle assembly of claim 1 wherein the tapered exterior surface portion of the adapter element and the tapered internal bore portion of the muzzle device are both surfaces of revolution.

11. The muzzle assembly of claim 1 wherein the muzzle device is adapted for mounting on the adapter element in unlimited range of angular orientations.

12. A muzzle assembly for a firearm with a barrel defining a barrel bore and having a threaded muzzle, the muzzle device comprising:

an adapter element defining an adapter bore centered on an adapter bore axis;

a portion of the adapter bore being internally threaded to removably mate with the threaded muzzle with the adapter bore registered with the barrel bore;

the adapter element having a tapered exterior surface portion;

a muzzle device defining a device bore and having a tapered internal bore portion adapted to be closely received on the tapered exterior surface portion of the adapter element;

a first one of the muzzle device and the adapter element having a threaded portion;

a collar element internally threaded to mate with the threaded portion of the first one of the muzzle device and the adapter element;

a second one of the muzzle device and the adapter element having an engagement surface; and the collar element being axially engaged to the engagement surface of the second one of the muzzle device and the adapter element and rotatably independent of the muzzle device, such that with the muzzle device oriented in a selected orientation with respect to the adapter element, rotation of the collar draws the muzzle device onto the adapter element and wedges the tapered exterior surface portion of the adapter element into the tapered internal bore portion of the muzzle device to prevent unwanted rotation of the muzzle device with respect to the adapter element.

13. The muzzle assembly of claim 12 wherein the tapered exterior surface portion of the adapter element is frustoconical.

14. The muzzle assembly of claim 12 wherein the tapered exterior surface portion of the adapter element is forward of the threaded portion of the first one of the muzzle device and the adapter element.

15. The muzzle assembly of claim 12 wherein the adapter element includes a tool-engagement facility adapted to enable a torque tool to secure the adapter element to the barrel.

16. The muzzle assembly of claim 12 wherein the tool-engagement facility includes a flat surface forward of the tapered exterior surface portion of the adapter element.

17. The muzzle assembly of claim 12 wherein the adapter element includes a forward-facing shoulder forward of the threaded portion of the first one of the muzzle device and the adapter element.

18. The muzzle assembly of claim 12 wherein the tapered exterior surface portion is angularly offset from the adapter bore axis by less than 45°.

19. The muzzle assembly of claim 12 wherein the muzzle device has an external forward-facing shoulder and the collar has an abutting internal rearward facing shoulder, such that the collar is adapted to forcibly draw the muzzle device in a rearward direction.

20. The muzzle assembly of claim 12 wherein the tapered exterior surface portion of the adapter element and the tapered portion of the muzzle device have the same shape.

21. The muzzle assembly of claim 12 wherein the tapered exterior surface portion of the adapter element and the tapered internal bore portion of the muzzle device are both surfaces of revolution.

22. The muzzle assembly of claim 12 wherein the muzzle device is adapted for mounting on the adapter element in unlimited range of angular orientations.

* * * * *